US005634413A

United States Patent [19]

Listner et al.

[11] Patent Number: 5,634,413

[45] Date of Patent: Jun. 3, 1997

[54] METHOD FOR THERMAL OXIDATION OF LIQUID WASTE SUBSTANCES W/TWO-FLUID AUTO-PULSATION NOZZLES

[75] Inventors: Uwe Listner, Hürth; Martin Schweitzer, Leverkusen, both of Germany

[73] Assignee: Bayer Aktiengesellschaft, Leverkusen, Germany

[21] Appl. No.: 550,903

[22] Filed: Oct. 31, 1995

[30] Foreign Application Priority Data

Nov. 7, 1994 [DE] Germany ..... 44 39 670.8

[51] Int. Cl.[6] ..... F23G 7/04

[52] U.S. Cl. ..... 110/238; 110/346; 110/215; 239/66; 239/429

[58] Field of Search ..... 110/215, 238, 110/341, 346, 262; 239/66, 398, 419.3, 429, 431, 599; 261/78.2, 116, 118, DIG. 9, DIG. 39; 431/1, 5, 12

[56] References Cited

U.S. PATENT DOCUMENTS 2,879,948 3/1959 Seibel .
4,974,530 12/1990 Lyon ..... 110/346

FOREIGN PATENT DOCUMENTS 945713 1/1956 Germany .
1751001 8/1970 Germany .
1776082 6/1971 Germany .
2548110 5/1976 Germany .
2547462 4/1977 Germany .
3625397 8/1992 Germany .

OTHER PUBLICATIONS

Nachrichten aus der Industrie, in "Mull und Abfall", vol. 1, S. 45 and 46 (1992).

*Primary Examiner*—Henry A. Bennett
*Assistant Examiner*—Pamela A. O'Connor
*Attorney, Agent, or Firm*—Sprung Horn Kramer & Woods

[57] ABSTRACT

In the method, the liquid waste substance is vaporized and oxidized in a stream of hot flue gas 4. This stream of flue gas 4 contains the oxygen necessary for oxidation. The essence of the method is that the liquid waste substance is sprayed into the stream of hot flue gas 4 as a fan-shaped flat jet with a component which is perpendicular to the main direction of flow, by means of one or more dual-substance nozzles 6 which are operated in a pulsed mode at a frequency of 5 $s^{-1}$ to 70 $s^{-1}$, and preferably 10 $s^{-1}$ to 20 $s^{-1}$, a fan-shaped spray carpet 7 with relatively large droplets of large range and a fan-shaped spray carpet 7 with relatively fine droplets of small range being generated in an alternating cycle at each dual-substance nozzle 6, so that the stream of flue gas 4 is supplied alternately with finely sprayed droplets of small range and large droplets which penetrate the flue gas with a relatively large range of throw. Numerals refer to FIG. 1.

6 Claims, 5 Drawing Sheets

Section A-B

METHOD FOR THERMAL OXIDATION OF LIQUID WASTE SUBSTANCES W/TWO-FLUID AUTO-PULSATION NOZZLES

The invention concerns a method for complete thermal oxidation of liquid waste substances. In this method, the waste substance is introduced into a stream of hot flue gas, vaporized and thermally oxidized. In order that this can be achieved, the stream of flue gas must contain the oxygen necessary for oxidation.

Such methods are known in the art and described in e.g. Chem. Ing. Tech. 63 (1991), pages 621–622. A key element in these methods is the utilization of the thermal energy of a stream of flue gas coming from a combustion installation for the purpose of thermally oxidizing and thereby disposing of liquid waste substances. The oxygen necessary for this oxidation process is delivered with the stream of hot flue gas; i.e., the stream of hot flue gas must contain sufficient quantities of oxygen. If the hot flue gas is generated by e.g. a waste combustion installation, then an excess of oxygen must be used in combustion so that a portion of the unconsumed oxygen is drawn away with the hot flue gas.

The installation used is a combustion installation with an afterburning chamber to which are delivered the liquid waste substances which are to be disposed of. Installed within the afterburning chamber, depending on the technical equipment level, are one or more special burners to which the liquid waste combustible substance is admitted. The liquid waste combustible substance is thereby finely atomized in the burner flame. The resultant droplet cluster takes the form of a full cone. Each burner is also supplied with a sufficient quantity of combustion air and the compressed air necessary for atomizing the liquid waste substance. The atomized liquid exists initially as a collection of droplets, moving into the combustion chamber at the initial speed of atomization. Flowing between the individual droplets is the atomizing air, emitted from the nozzle at acoustic velocity. This diphasic mixture is enveloped by the initially relatively cold combustion air. Initially, therefore, combustion is prevented, since there exists neither a combustion gas and air mixture lying between a lower and an upper explosion limit nor the necessary ignition temperature. Cross-mixing results in rapid vaporization of minimal-sized droplets of combustible substance penetrating into the outer region of the combustion air, due to the existence there of a mixture of combustion air and hot flue gas. Combustion therefore commences. Due to the heat which is then released and further progressive mixing of the dipbasic mixture of liquid droplets and atomizing air, present in the core, with hot flue gases, more and more combustible substance is burned in a self-accelerating process. The combustion process is greatly influenced by this mixing behaviour in the flame. There have therefore been many attempts to effect constructional design measures to achieve better intermixing of the hot flue gas with the burner spray. In each case, the objective is the most complete combustion possible of the sprayed-in waste substances, i.e., the most complete burn-up.

The combustion of combustible liquid waste substances in an afterburning chamber is always problematical where, due to the geometrically determined disposition of the burner in the combustion chamber and the flow conditions prevailing in the combustion chamber, the flame formed with the waste combustible substance flickers instead of burning constantly. Such instabilities can occur if the composition of the substance varies over time and/or if it is not possible to avoid wall contact with non-burned droplets. If there are several burners on one plane, then there is the particular problem of the flames being affected by each other and that of the intermixing of the streams of flue gas produced by the individual burners with the total stream of flue gas.

The object of the invention is to introduce even low-combustibility liquid waste combustible substances into the afterburning chamber in such a way that a complete burn-up is assured, even in unfavourable combustion conditions.

Taking as a basis the method described at the beginning, this object is achieved, according to the invention, in that the liquid waste combustible substance is sprayed into the stream of hot flue gas as a fan-shaped flat jet with a flow component which is perpendicular to the main direction of flow, by means of one or more dual-substance nozzles which are operated in a pulsed mode at a frequency of 5 $s^{-1}$ to 70 $s^{-1}$, and preferably 10 $s^{-1}$ to 20 $s^{-1}$, a fan-shaped spray carpet with relatively large droplets of large range and a fan-shaped spray carpet with relatively fine droplets of small range being generated in an alternating cycle at each dual-substance nozzle, so that the stream of flue gas is supplied alternately with finely sprayed droplets of short range and large droplets which penetrate the flue gas with a relatively large range of throw.

The liquid waste substance is preferably sprayed into a stream of flue gas which has a temperature of at least 800° C. and an oxygen content which is at least sufficiently high to assure complete oxidation of the combustible substances.

The geometry of the dual-substance nozzles and the flow conditions (throughput and operating pressures) are selected so that the included angle of the fan-shaped spray carpets is 60° to 160°.

According to a preferred embodiment, the atomizing gas throughput and the liquid throughput at the dual-substance nozzles are set so that the time-averaged volumetric flow ratio of the air and liquid streams at each dual-substance nozzle lies within the range of 0.01 to 0.2, while the instantaneous value of the volumetric flow ratio varies according to the pulsation frequency.

The pulsed operating mode can be achieved by a periodic admission of compressed gas or liquid to the dual-substance nozzle. Alternatively, the pulsed operation can also be generated by flow control measures within the dual-substance nozzle itself, with the admission of compressed air and liquid being constant in respect of time.

The following advantages are achieved with the invention:

- There is rapid and complete oxidation of all oxidizable liquid waste component substances.
- Operationally reliable oxidation is assured, even with liquid wastes, waste waters and sludges of low calorific value and even with widely varying thermal values.
- Unlike the case of conventional burners in the afterburning chamber, there is no need for additional combustion air supplies or for any ignition or pilot burners.
- The fineness of the droplets, the range and the spraying angle of the atomized droplet cluster can be varied within wide limits and thus adapted to existing combustion chamber geometries. This also renders possible retroactive installation, or retrofitting of already existing installations.
- Even with a maximum throughput of liquid waste, it was not possible to ascertain any increase in the CO content in the gas stream leaving afterburning chamber.

The invention is described more fully below with reference to drawings and embodiment examples, wherein.

Figure 1:
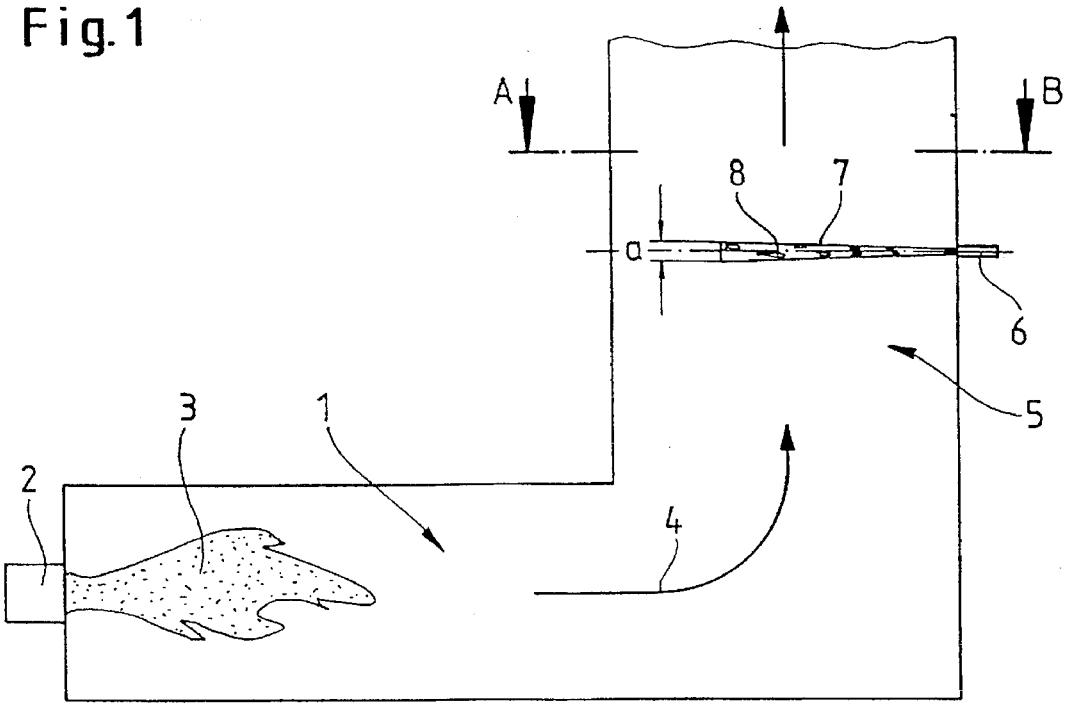
FIG. 1 shows, in schematic form, a cross section through a main and afterburning chamber for atomizing and burning a liquid waste substance.

FIG. 1 depicts, in schematic form, a main combustion chamber 1 with a burner 2 and a main flame 3. The main flame 3 is supplied with such a quantity of combustion air or oxygen that the flue gas 4 flowing out of the main combustion chamber 1 still has a substantial residual oxygen content (more than 6%). The oxygen content of the flue gas can be varied by the supply of a greater or lesser excess of oxygen or combustion air to the main flame 3.

The flue gas 4 containing the oxygen leaves the main combustion chamber 1 at a temperature of 1000° C. to 1400° C. and then flows into the afterburning chamber 5. Sprayed into the afterburning chamber 5 are liquid waste combustible substances, which are then thermally oxidized with the residual oxygen in the stream of hot flue gas and thereby disposed of. Normally (depending on the technical equipment level), there are one or more burners installed in the afterburning chamber which are equipped with their own burner air supply. The liquid waste substances to be treated are sprayed directly into the flames of these burners.

Figure 2:
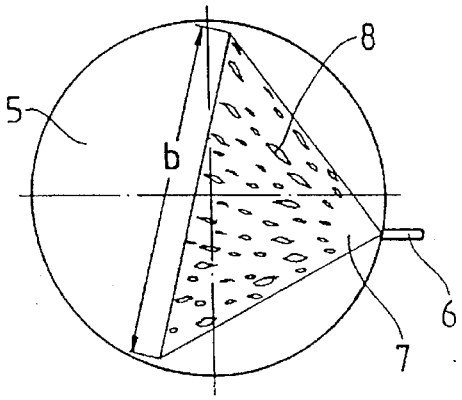
FIG. 2 shows the fan-shaped spray carpet of the atomized liquid.

In the case of the new method, there are no burners in the afterburning chamber. The liquids which are to be oxidized are sprayed in the form of a fan into the stream of flue gas by means of special dual-substance nozzle lances 6. The fan-shaped spray carpet 7 is shown in FIG. 2. Its cross dimension b is substantially greater than its thickness a (see FIG. 1). The essential difference, compared with conventional nozzle lances, is that the dual-substance nozzle lances 6 used here generate a fan-shaped spray carpet with relatively large droplets of large range and a fan-shaped spray carpet with relatively fine droplets of small range in an alternating cycle, so that the stream of flue gas 4 is supplied alternately with finely sprayed droplets of small range and large droplets which penetrate the flue gas with a relatively large range of throw. This pulsed operation is designated hereinafter as a "bimodal operating mode".

Figure 3:
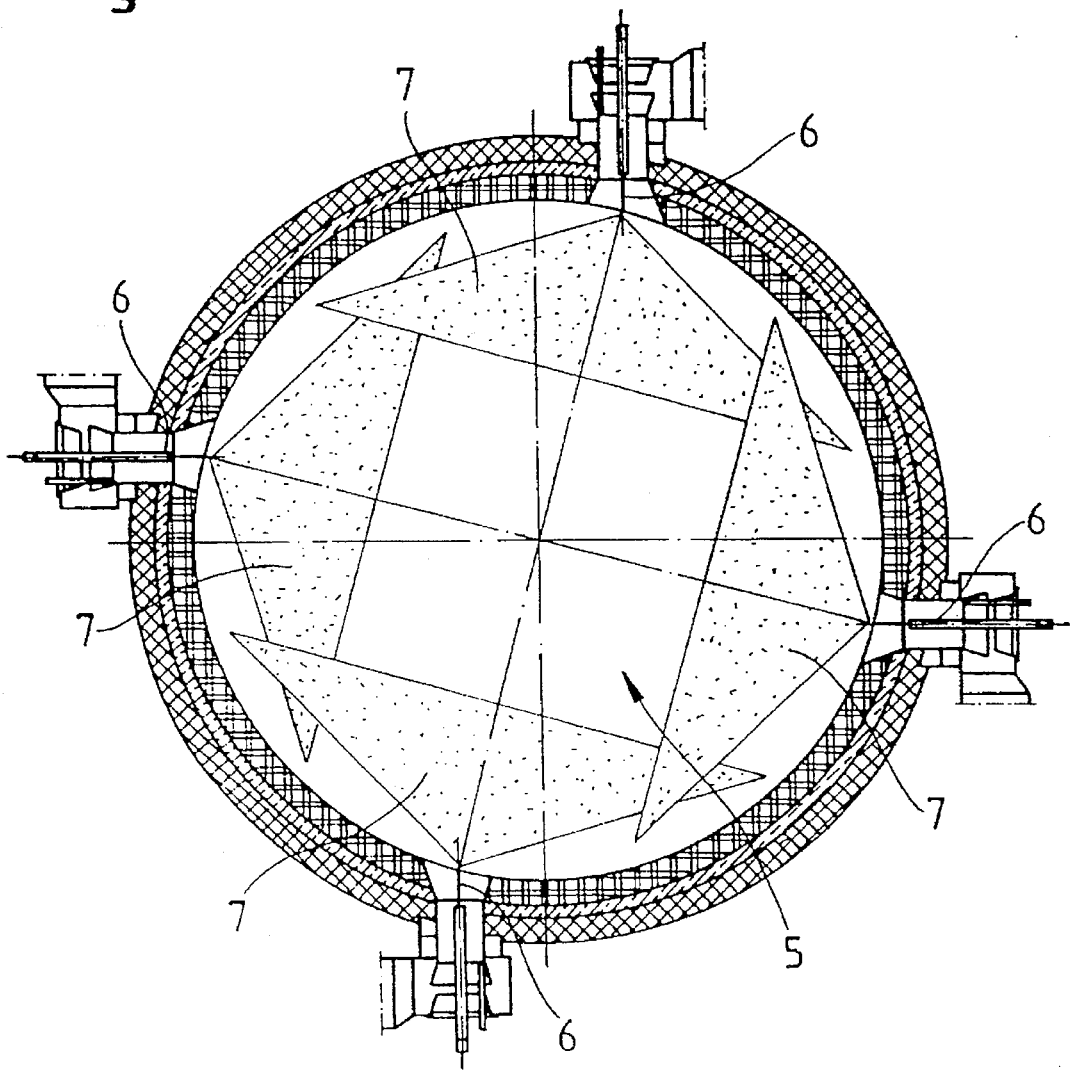
FIG. 3 shows a cross section through the afterburning chamber, depicting the arrangement of the dual-substance nozzles and the spatial configuration of the spray carpets within the afterburning chamber.

In FIG. 3, four bimodal dual-substance nozzle lances 6 are disposed in a rotationally symmetrical arrangement in the afterburning chamber 5. There is partial overlapping of the fan-shaped spray carpets 7 of the dual-substance nozzle lances 6. The atomizing gas, e.g. air, and the liquid which is to be disposed of are each supplied to a bimodal dual-substance nozzle lance 6. The included angle of the fan-shaped spray carpets is about 120°. The spraying plane is perpendicular to the main direction of flow of the hot flue gases, although this is not a condition which need be precisely adhered to. In the bimodal operating mode, large and fine droplets of different velocities and consequently different ranges of throw become separated from each other. This prevents the formation of a tight vapour cloud which could not be easily penetrated by the surrounding hot flue gases. The bimodal atomization is also characterized by a very wide droplet spectrum. With a throughput of 1.5 $m^3/h$, both large droplets of approximately 2 mm in diameter and a range of about 6 m and small droplets of about 30 μm with a range of about 0.4 m were observed. A fundamental characteristic of this operating mode is the very rapid alternation between fine droplets and large droplets. The fine droplets are generated when the dual-substance nozzle lance operates in the dual-substance atomizing mode. The large droplets, on the other hand, are produced in the ensuing pressure-nozzle operation. The fine droplets vaporize rapidly and also ignite rapidly in the hot atmosphere. This results in a self-stabilizing flame in the proximity of the nozzle. The turbulence balls 8 formed from vapour and flue gas which are produced upon contact with the flue gas are considerably smaller than is the case in conventional afterburning due to the fact that vaporization of the liquid is not prevented by either significant collections of droplets or cold combustion air and also that these do not retard the mixing with the hot flue gas. In the case of the large droplets in particular, a vapour trail is generated along their flight path with spatially varying flue gas to vapour mix ratios, the volume ratio of steam to oxygen-containing flue gas becoming progressively smaller with time. If a combustible mixture is locally present, then stable combustion ensues after an ignition delay time which lies within the ms range. However, if the lower ignition limit is not attained by the mixing processes during the ignition delay time, no further combustion can occur. It was ascertained, with surprise, that flameless oxidation occurs instead after a further mixing with the flue gas. This ensures that oxidation occurs, with or without a flame, irrespective of the combustible material, its vaporization and the intermixing of flue gas. The improvements described above mean that it is possible to achieve complete oxidation of all oxidizable liquid waste components.

The design of the dual-substance nozzle lances 6 used here for bimodal operation is described below. These dual-substance nozzle lances make use of a special pulsation nozzle.

Figure 4:
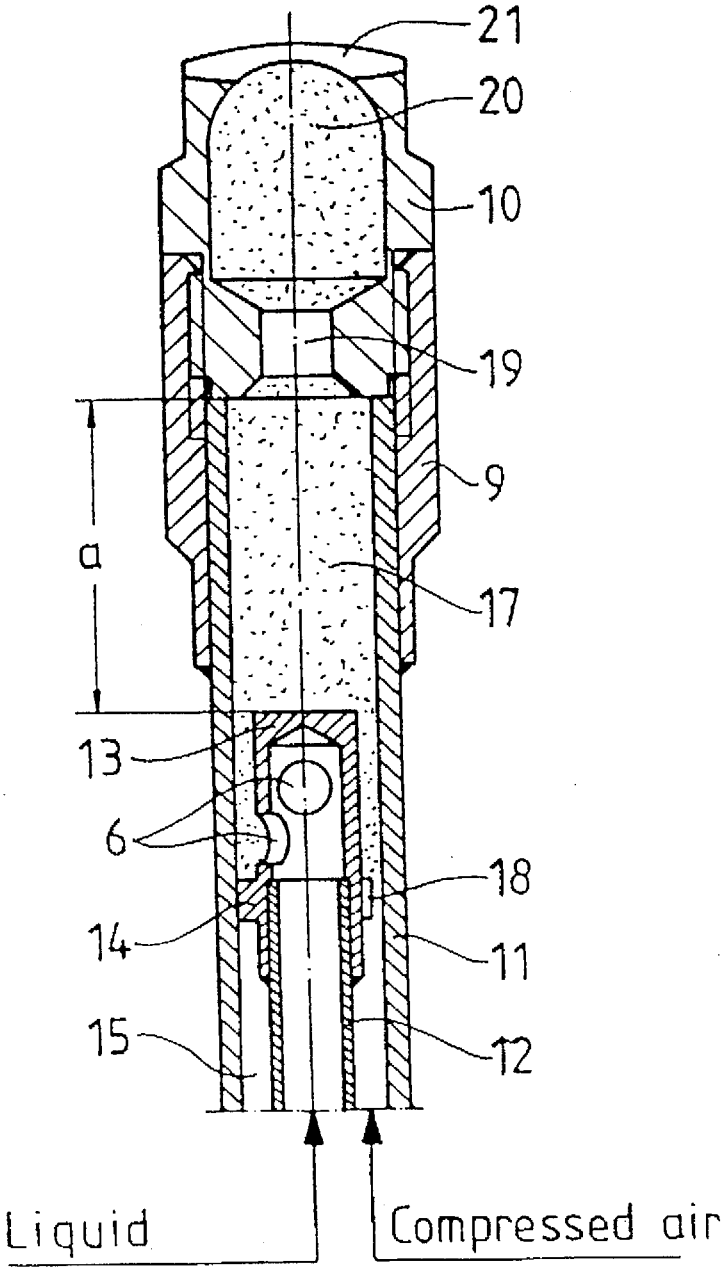
FIG. 4 shows the structure of a dual-substance nozzle suitable for bimodal operation.

The pulsation nozzle forms the front part of the nozzle lance 6 depicted in FIGS. 1 to 3 and, as shown in FIG. 4, consists of a commercially available flat-jet nozzle 10 screwed into a weld-on sleeve 9, a jacket tube 11 which is fixed to the weld-on sleeve 9, an inner tube 12 which is axially displaceable within the jacket tube 11 and a liquid distributor 13 mounted on the inner tube. The inner tube 12 with the mounted-on liquid distributor 13 is mounted by means of centering webs 14 so that it is capable of axial displacement within the jacket tube 11. The drawing does not show the necessary sealing between the displaceable inner tube 12 and the jacket tube 11.

The liquid which is to be oxidized flows through the inner tube 12 and compressed air, as a gaseous atomizing medium, flows through the annular gap 15 between the inner tube 12 and the jacket tube 11. The liquid distributor 13 consists of a piece of tube, closed at the end, which is mounted on the inner tube 12, with mutually offset outlet holes 16 aligned perpendicularly to the axis. The liquid which is to be oxidized passes out of the inner tube 12, through the outlet holes 16, into a first resonance chamber 17 which adjoins the distributor 13, while the compressed air is delivered through the annular gap between the inner tube 12 and the jacket tube 11. The compressed air flows through the groove-type free spaces 18 between the centering webs 14. The outlet holes 16 are disposed in the distributor 13 so that they each lie in an axial elongation of the centering webs 14 which partially close the cross section of the annular gap; i.e., the outlet holes 16 lie within the dead space, or in the flow shadow, behind the centering webs 14. In this way, mingling of the liquid phase and the gaseous phase (compressed air) in the resonance chamber 17 is largely precluded.

The resonance chamber 17 is bounded lengthwise by the jacket tube 11, at the inlet end by the liquid distributor 13 and at the outlet by a throttle or aperture 19 with a cross section which is much less than the inner diameter of the resonance chamber 17. Displacement of the inner tube 12 within the jacket tube 11 changes the effective length a and therefore also the volume of the resonance chamber 17.

Adjoining the aperture 19 there is a further resonance chamber 20. The diphasic mixture of compressed air and waste liquid which is present in the second resonance chamber 20 enters the flue gas channel through the actual nozzle opening on the nozzle head, which is depicted here as a narrow rectangular slot 21. The second resonance chamber 20 can thus be regarded as an atomizing chamber. It would also be quite possible for more than two resonance chambers to be connected in series, each being separated from the other by apertures or throttles.

It has been found that, when this dual-substance nozzle is operated with a constant compressed air and liquid admission pressure, the liquid is ejected in pulses. The pulsation frequency can be set through the volume of the resonance chamber 17 and lies within a typical frequency range of 5 $s^{-1}$ to 70 $s^{-1}$. Experiments have shown that, in such a pulsed operation, a spray fan with relatively large droplets of large range and a spray fan with relatively fine droplets of small range are generated at each dual-substance nozzle in an alternating cycle. The pulsation frequencies of the nozzle lances 6 can differ. The relatively large droplets result from the fact that, in this phase, it is practically only liquid that is ejected, while the substantially smaller droplets produced in the ensuing fine-spray phase are due to atomization by the expanding compressed air. This bimodal atomization produces a very wide droplet spectrum, the large droplets being characterized by a particularly large range of throw. A particularly uniform and good heat and substance exchange is thus achieved between a small quantity of liquid and a relatively large quantity of gas. Atomization occurs at an admission pressure of 0.8 to 2.5 bar and with a compressed air to liquid volumetric flow ratio of between 0.01 and 0.2.

Figure 5:
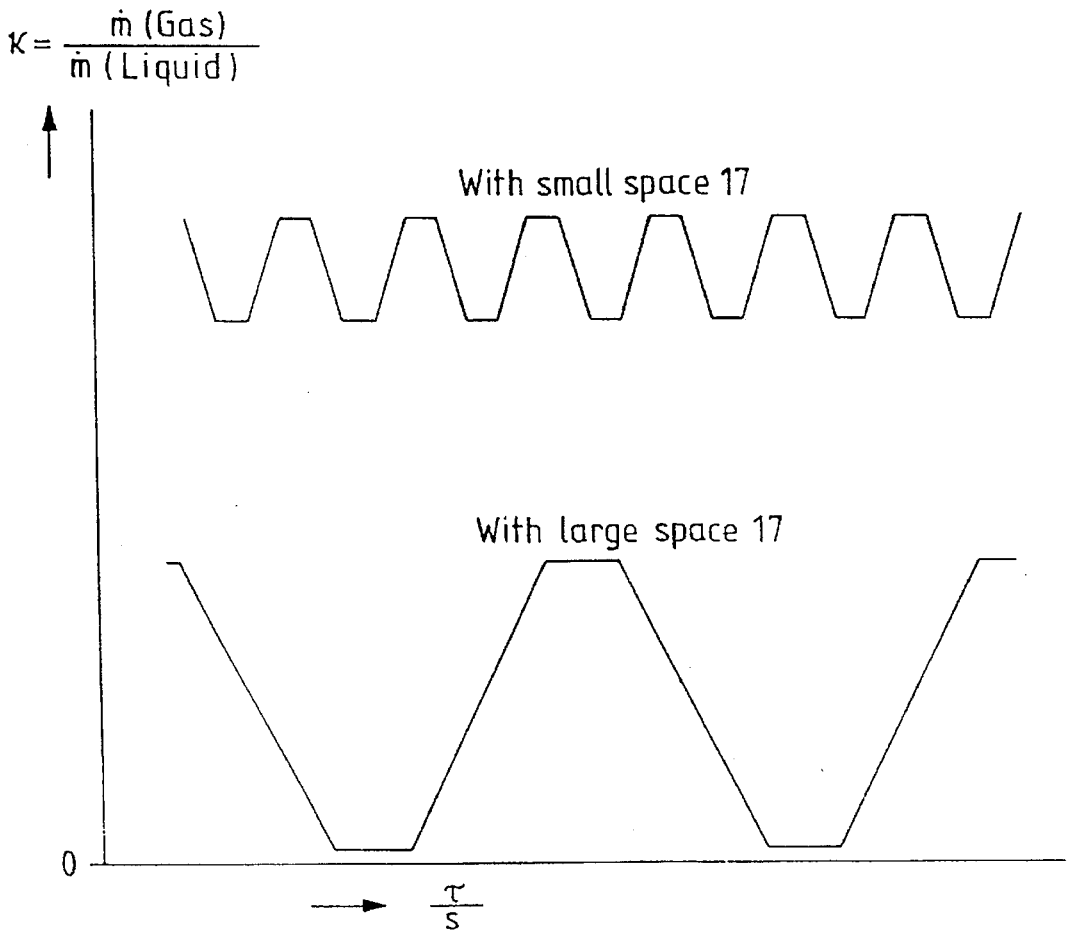
FIG. 5 shows the instantaneous value of the volumetric flow ratio of the streams of air and liquid in bimodal operation of the dual-substance nozzle.
Figure 6:
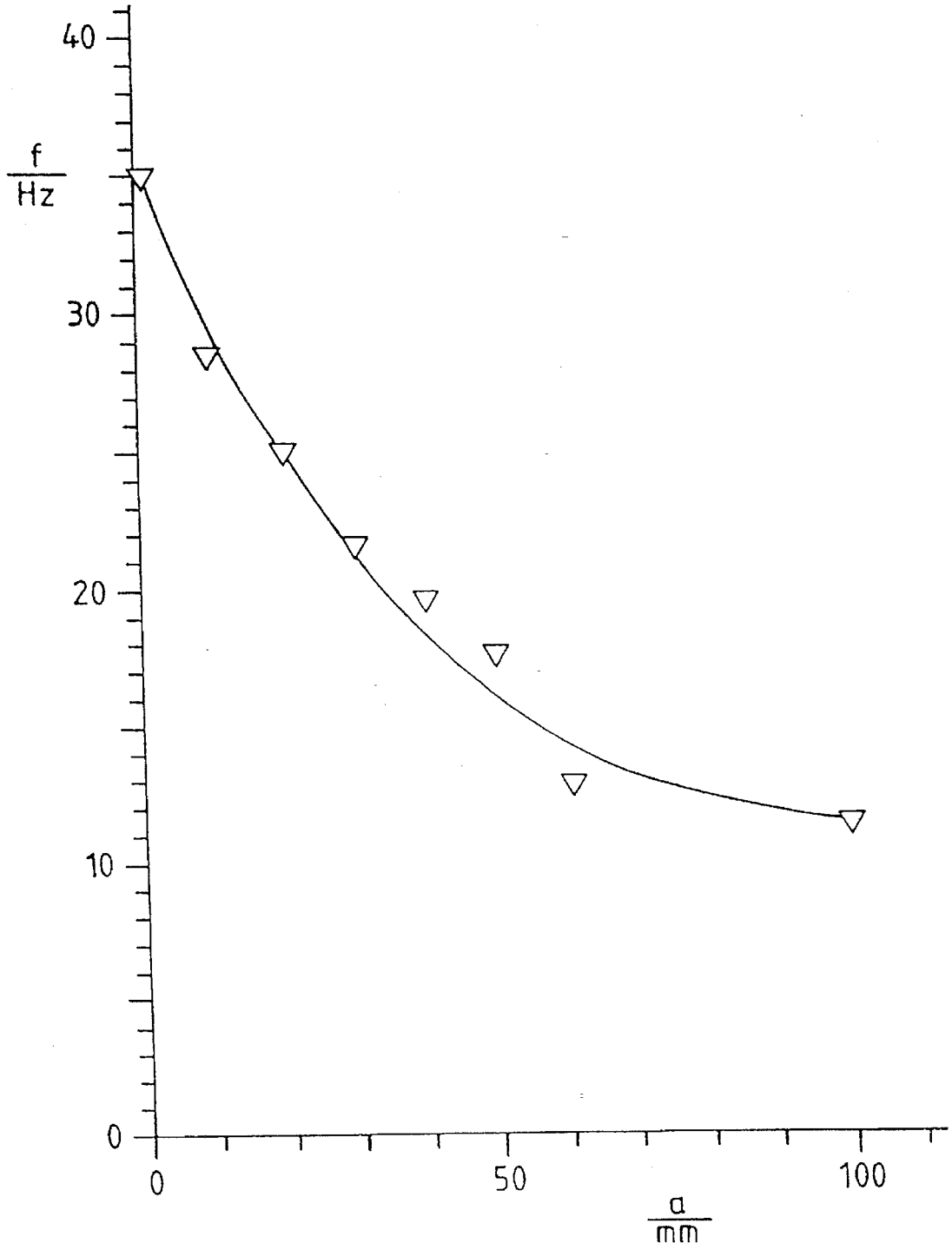
FIG. 6 shows the dependence of the pulsation frequency on the length of the first resonance chamber in the dual-substance nozzle.

The diagram in FIG. 5 shows the instantaneous value K of the volumetric flow ratio for a pulsed operation of the dual-substance nozzle depicted in FIG. 4 as a function of time. In one extreme case, liquid and compressed air flow alternately through the throttle 19 while in the other extreme case the volumetric flow ratio K of the gaseous and liquid phase flowing simultaneously through the throttle point exhibits practically no variation. The liquid and gas mixture, its composition varying periodically, passes out of the atomizing space 20 (final resonance chamber) through the flat jet nozzle outlet surface 21 into the flue gas channel. As shown in FIG. 5, the volumetric flow ratio K tends from an upper limiting value—corresponding to a high proportion of gaseous atomizing medium in the total volume flowing through the nozzle slot 21—towards a lower limiting value, then rising again to the peak value. The upper limiting value corresponds to the state of fine atomization with a small range and the lower limiting value corresponds to the formation of large droplets with a large range. This process is repeated periodically. The repetition frequency or pulsation frequency can be selectively varied by enlarging or reducing the volume of the resonance chamber 17. If, for example, the volume is enlarged by increasing the distance a, then the frequency is reduced (lower partial diagram in FIG. 5), while the pulsation frequency is increased if the volume is reduced (upper partial diagram in FIG. 5). The dependence of the pulsation frequency on the length a of the resonance chamber 17, measured at a dual-substance nozzle as shown in FIG. 3 and FIG. 4, is depicted in FIG. 6. The volume of the resonance chamber 17 could also be varied by the provision of side chambers, connected as required.

In the case of the resonance chamber dual-substance nozzle described above, the pulsation operation is self-regulating (auto-pulsation). Auto-pulsation of the system of the two resonant chambers 17, 20 which are connected in series, occurs by exciting the resonant system which is filled by the liquid-gas mixture by supplying the compressed air and liquid into the resonant chamber under constant pressure. An analogous representation of this occurrence would be similar to the key feature for producing the sound in a flute or a whistle. The resonance chamber, in a flute or whistle, is excited to acoustic oscillations when a "constant" airflow is blown into the flute or whistle. Instead of auto-pulsation operation, forced pulsation can also be effected if a dual-substance nozzle is periodically supplied with compressed air or liquid. This can be effected through e.g. so-called flutter valves built into the compressed air or liquid delivery lines.

EXAMPLES

The following experiments were conducted using a cresol residue as the liquid waste substance.

| | |
|---|---|
| Experiment 1 | |
| Liquid residue | Cresol |
| Liquid pressure with air and product | 2.5 bar |
| Product throughput | 1500 l/h |
| Atomizing air flow | 115 $m^3/h$ |
| Combustion air flow | 4200 $m^3/h$ |
| Combustion chamber temperature | 1100° C. |
| $O_2$ content in flue gas | 10.2% |
| CO content in flue gas | 5 $mg/m^3$ |
| Flame: carpet form, ignition about 500 mm from nozzle, bright. | |
| Experiment 2 | |
| Liquid residue | Cresol |
| Liquid pressure with air and product | 2.5 bar |
| Product throughput | 2000 l/h |
| Atomizing air flow | 100 $m^3/h$ |
| Combustion air flow | 4200 $m^3/h$ |
| Combustion chamber temperature | 1120° C. |
| $O_2$ content in flue gas | 8.5% |
| CO content in flue gas | 5 $mg/m^3$ |
| Flame: as above. | |
| Experiment 3 | |
| Liquid residue | Cresol |
| Liquid pressure with air and product | 2.0 bar |
| Product throughput | 700 l/h |
| Atomizing air flow | 80 $m^3/h$ |
| Combustion air flow | 4500 $m^3/h$ |
| Combustion chamber temperature | 1120° C. |
| $O_2$ content in flue gas | 7.2% |
| CO content in flue gas | 5 $mg/m^3$ |
| Flame: Start about 400 mm from nozzle, very bright, almost white carpet | |
| Experiment 4 | |
| Liquid residue | Cresol |
| Liquid pressure with air and product | 2.5 bar |
| Product throughput | 1200 l/h |
| Atomizing air flow | 115 $m^3/h$ |
| Combustion air flow | 4400 $m^3/h$ |
| Combustion chamber temperature | 1100° C. |
| $O_2$ content in flue gas | 9.5% |
| CO content in flue gas | 5 $mg/m^3$ |
| Flame: Somewhat more voluminous than previously. | |

We claim:

1. Method for complete thermal oxidation of liquid waste substances in which the waste substance is vaporized and oxidized in a stream of hot flue gas (4) which also contains the oxygen necessary for oxidation, characterized in that the liquid waste combustible substance is sprayed into the stream of hot flue gas (4) as a fan-shaped flat jet with a component which is perpendicular to the main direction of flow, by means of one or more two-fluid nozzles (6) which are operated in a pulsed mode at a frequency of 5 $s^{-1}$ to 70 $s^{-1}$, and preferably 10 $s^{-1}$ to 20 $s^{-1}$, a fan-shaped spray carpet with relatively large droplets of large range and a fan-shaped spray carpet (7) with relatively fine droplets of small range being generated in an alternating cycle at at least one said two-fluids nozzle (6), so that the stream of flue gas (4) is supplied alternately with finely sprayed droplets of small range and large droplets which penetrate the flue gas with a relatively large range of throw.

2. Method according to claim 1, characterized in that the liquid waste substance is sprayed into a stream of flue gas (4) which has a temperature of at least 800° C. and an oxygen content which is at least sufficiently high to assure complete oxidation of the combustible substances.

3. Method according to claim 1, characterized in that the included angle of the fan-shaped spray carpet (7) is 60° to 160°.

4. Method according to claim 1, characterized in that the atomizing gas throughput and the liquid throughput are set so that the time-averaged volumetric flow ratio of the air and liquid streams at at least one said two-fluid nozzle (6) lies within the range of 0.01 to 0.2, while the instantaneous value of the volumetric flow ratio varies according to the pulsation frequency.

5. Method according to claim 1, characterized in that the pulsed operation is effected through a periodic admission of compressed gas or liquid to at least one said two-fluid nozzle (6).

6. Method according to claim 1, characterized in that the pulsed operation is generated fluidically within at least one said two-fluid nozzle (6) itself, with the admission of compressed air and liquid being constant in respect of time.

* * * * *